United States Patent [19]

Bergman

[11] 4,144,988

[45] Mar. 20, 1979

[54] TWIST TOP ACTUATED DISPENSER WITH FOLLOWER

[75] Inventor: Carl P. Bergman, Lighthouse Point, Fla.

[73] Assignee: Bridgeport Chemical Corporation, Pompano Beach, Fla.

[21] Appl. No.: 825,393

[22] Filed: Aug. 17, 1977

Related U.S. Application Data

[63] Continuation-in-part of Ser. No. 683,238, May 4, 1976, abandoned.

[51] Int. Cl.[2] ..... B67O 5/42

[52] U.S. Cl. ..... 222/390

[58] Field of Search ..... 222/390, 327

[56] References Cited

U.S. PATENT DOCUMENTS

| | | | |
|---|---|---|---|
| 2,728,097 | 12/1955 | Seifert | 222/390 X |
| 2,744,664 | 5/1956 | Paterson | 222/390 X |
| 3,156,387 | 11/1964 | Harwood | 222/390 X |
| 3,595,448 | 7/1971 | Carlton | 222/327 |
| 3,993,226 | 11/1976 | Pavenick | 222/390 X |

FOREIGN PATENT DOCUMENTS

| | | | |
|---|---|---|---|
| 1320082 | 1/1963 | France | 222/390 |
| 1471147 | 1/1967 | France | 222/390 |

*Primary Examiner*—David A. Scherbel

*Attorney, Agent, or Firm*—Cushman, Darby & Cushman

[57] ABSTRACT

A piston, lead screw, dispenser rear end wall and twistable projection are assembled together. On the filling line, tubes each with a dispenser spout at one end, are filled through the opposite end and closed by securing the rear end wall of the assembly to the tube as a closure for the open end. In one embodiment the tube and end wall are made of plastic material and the securement is by ultrasonic welding; in another, the tube is of foil/fiber composite, the end wall is of metal and the securement is accomplished by crimping. When the dispenser tip is opened, rotatably twisting the lead screw projection in one angular sense will advance the piston and discharge the tube's filling of caulking compound or the like, that is contained between the piston and the spout.

6 Claims, 3 Drawing Figures

TWIST TOP ACTUATED DISPENSER WITH FOLLOWER

REFERENCE TO RELATED APPLICATION

This is a continuation-in-part of my earlier, copending U.S. patent application, Ser. No. 683,238, filed May 4, 1976, now abandoned in favor hereof.

BACKGROUND OF THE INVENTION

For several years, standard-sized cartridges of grease, caulking compound, printer's ink, glazing putty, rubber cement, asphalt compounds and the like have been widely sold for do-it-yourself projects and for use by artisans such as roofers, carpenters, plumbers and automotive mechanics.

In general, these cartridges are made of a foil/fiber composite tube, or a tube of metal and/or plastic sheet. One end of the tube is fitted with a dispenser spout, often one which needs to be clipped off before the initial use, and a push-up opposite end. Such cartridges must be used in combination with a 'gun', that is a device which cradles the cartridge and has a trigger-operated, ratchet-advanced plunger arranged to engage and advance the push-up end of the cartridge. When the contents are exhausted, the empty cartridge is removed from the gun and thrown away.

Some potential users of such plastic fluid compounds contemplate using so little that they do not wish to buy both a cartridge and a gun. Other users, such as printers, use so little out of a cartridge at each use, and need so many different colors of ink, that changing cartridges in-and-out of one gun is waste-work, but buying a gun for each cartridge is hard to justify.

Although it may seem illogical to a person with a background in industry, there is also a largely unserved market composed of do-it-yourselfers who have a low tolerance for dealing with complexity. These people seem not to be assured they have the ability to put a cartridge in a caulking gun properly to use it as directed, and disassemble the combination when the cartridge is exhausted.

Dispensers on which a top is twisted to advance a piston along a lead screw to dispense a plastic, fluent product through a dispenser spout at the opposite end of a tubular container sidewall without the need for a separate 'gun', are part of the prior art.

SUMMARY OF THE INVENTION

A piston, lead screw, dispenser rear end wall and twistable projection are assembled together. On the filling line, tubes each with a dispenser spout at one end, are filled through the opposite end and closed by securing the rear end wall of the assembly to the tube as a closure for the open end. In one embodiment the tube and end wall are made of plastic material and the securement is by ultrasonic welding; in another, the tube is of foil/fiber composite, the end wall is of metal and the securement is accomplished by crimping. When the dispenser tip is opened, rotatably twisting the lead projection in one angular sense will advance the piston and discharge the tube's filling of caulking compound or the like, that is contained between the piston and the spout.

A major goal of the invention is to provide an assembly that can be easily fitted to filled tubes on an automated or semi-automated filling and closing line using easily executed techniques.

The principals of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
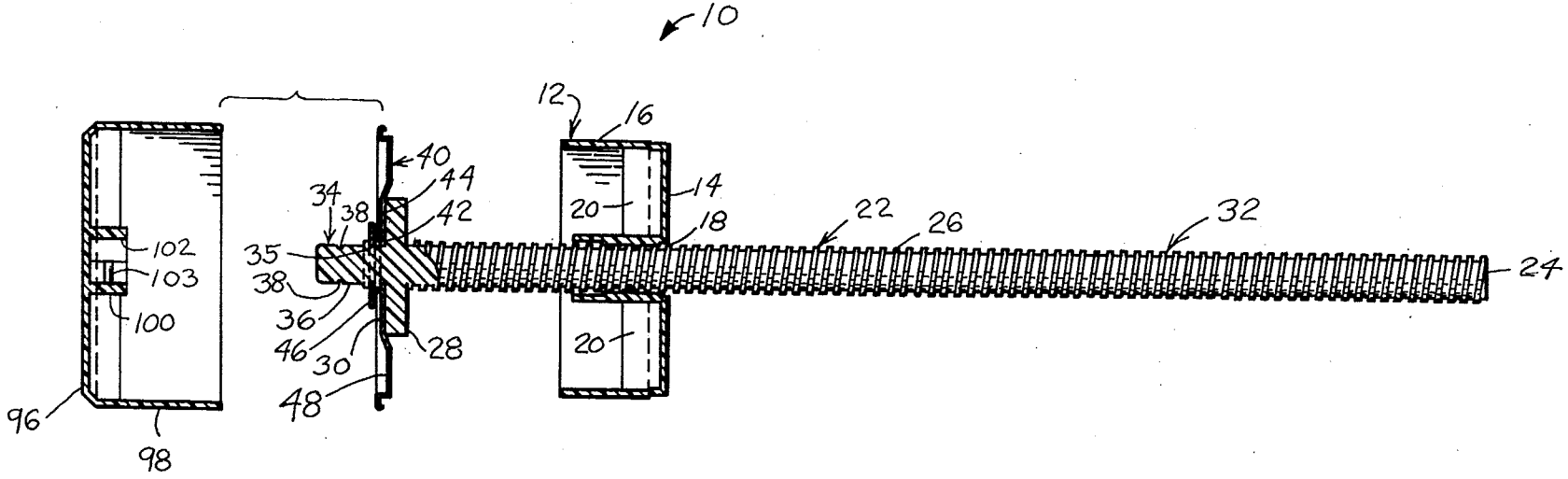
FIG. 1 is a longitudinal sectional view of the assembly, with a twist top therefor.

The dispenser assembly 10 includes a piston 12 with a disk-shaped forward face 14 and a tubular outer peripheral skirt 16 which projects axially rearwardly. Adjacent and extending to the face 14 the outer diameter of the skirt 16 is reduced slightly in an axially short band to provide a radial clearance between the skirt and the cylinder wall (to be described). An internally threaded tubular boss 18 opens centrally of the face 14 and is braced with respect to the skirt 16 and the rear of the face 14 by radiating spoke-like fins 20. Preferably the piston 12, including the elements 14-20 are molded as an integral until of plastic material such as glass-filled polypropylene.

The assembly 10 further includes a low pitch lead screw 22 (e.g. eleven turns per inch), preferably molded as a one-piece item out of the same material as the piston 12. At the forward end 24, the threading 26 runs off the end of the screw 22, but near the trailing end the threading 26 terminates at an integral, washer-like annular boss 28.

The boss 28 has a radially extending, flat trailing face 30.

The rod 32 which includes the lead screw 22 terminates in an axially short, integrally coaxially formed projection 34. Nearest the face 30, the projection 34 briefly is of cylindrical shape and bears a radially outwardly opening circumferential groove 35 intermediate the arial extent thereof.

The remainder 36 of the projection 34 is of generally square (non-circular) transverse cross-sectional shape. Two transversally extending, laterally outwardly opening grooves 38 are formed in two opposite sides of the projection portion 36 in opposite to one another.

The rod 32 may be molded as an integral unit, out of the same or a similar material as the piston 12.

The dispenser assembly 10 further includes a disk-shaped end wall 40 with a central opening 42 of a diameter just large enough to permit the end wall to be slipped over the projection 34 and advanced until the inner face 44 of the end wall facially abuts the flat, trailing face 30 of the boss 28. The end wall 40 is sufficiently thin that when it is in place, the groove 35 lies axially outside the end wall 40.

A split ring retainer 46 is snapped into the groove 35 to unite the assembly 10. The retainer 46 resiliently bears against the outer, trailing face 48 of the end wall 40 peripherally of the opening 42.

(Some contents that are to be dispensed are quite sensitive to contact with the air — either because they gain or lose water or lose solvent, oxidize or otherwise chemically react. Especially where that is the case, and the dispenser must be especially leakproof, a small, thin O-ring 50 may be interposed between the end wall face 48 and the split ring 46. As the ring 50 is resiliently axially squashed, it expands radially inwards (and outwards) forming a resilient seal by gasketing between the end wall 40 peripherally of the opening 42, and the projection 34.)

In any event, the dispenser assembly 10 is constituted by the rod 32, the piston 12 threaded thereon, and the end wall 40 secured thereto. The seal, e.g. the O-ring 50, as described, is a part of this assembly when needed.

The piston, end wall and rod are preferably sized to fit a standard-size tube or cartridge of caulking compound or the like so that the piston skirt is in wiping contact with the tube or cartridge sidewall, the end wall lids the tube or cartridge and the rod forward end is located at such a position that the piston will run off the forward end just as the contents are effectively substantially emptied from the tube or cartridge. For instance, the main portion of the skirt has an O.D. of 1.840 inch (1.80 inch in the annular relieved portion) and the part of the drive rod which will lie within the dispenser (i.e. the lead screw plus the annular boss) has a length of 7.875 inches. Of course, these dimensions are but typical and will differ for different size containers.

Figure 2:
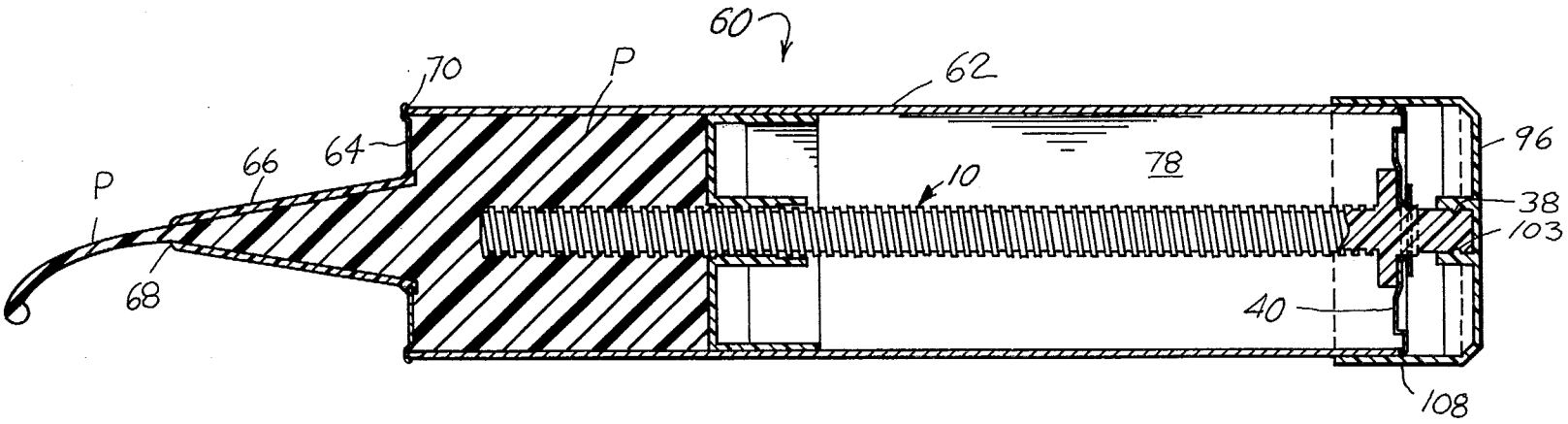
FIG. 2 is a longitudinal sectional view of a fiber/foil tube of fluent, plastic material provided with an assembly and twist top.

Referring to FIG. 2, the dispenser 60 includes a tubular body 62 with a forward end wall 64 having an axially, forwardly projecting dispenser spout 66, generally one whose tip 68 must first be clipped off before material can be dispensed. As an example, the tube 62 may be a spirally-wound foil/fiber composite. The end 64 may be made of metal and crimped in place at 70. The spout 66 may be made of injection molded polyethylene. In fact, the elements 62-70 described so far may be identical to those presently widely in use for the dispenser cartridge that are presently used with conventional, cradle-type trigger advanced piston-type caulking guns.

The tube 62 lumen 78 is filled with viscous plastic product P, leaving room for the dispenser assembly.

The dispenser assembly 10 of FIG. 1 is then inserted in the tube lumen 78, with the piston fully retracted, and the whole assembly is advanced until the end wall 40 coaxially abuts the tube 62 at the trailing end of the tube lumen 78. The radially outer margin of the end wall 40 is then circumferentially secured to the tube 62 end at 108. Preferably the securement is by crimping as shown in FIG. 2.

The main portion of the piston skirt and the piston end are of such large diameter that the piston substantially radially fills the cross-section of the lumen 78.

A twist top 96 is provided, having an outer peripheral surface 98 that is grooved or knurled for easier gripping.

In its underside, the twist top 46 is provided with a boss 100 with a non-circular e.g., square-sectioned socket 102. The non-circular socket 102 fits with and receives the projection 36 on the rod 32. In the example shown, a bead and groove set 103, 38 respectively in the socket 102 and on the end portion 36 snap together upon insertion of the projection 36 into the socket 102 for securing the twist top 96 on the rod 32.

By preference, the rod 32 threading is very low pitch, square profile threading and the threading inside the piston is complementary. Accordingly, as the top 96 is twisted, the rod 32 is rotated and the piston axially advances without rotating. This is due to the light frictional engagement of the piston with the tube wall, the viscous nature of the tube contents acting on the piston face in contacting with the tube contents and the low pitch of the threading. Accordingly, in practice, no extra means need be provided to restrain the piston against rotation.

The forward end of the rod 32 may project into the dispenser spout a short way to provide a bearing, but that is not necessary if the rod is stiff and securely mounted at its twist top carrying end.

The product P is dispensed by snipping off the tip 68 and twisting the top 96 to advance the piston. The whole article 60 may be simply disposed of when the supply of product P is exhausted.

Figure 3:
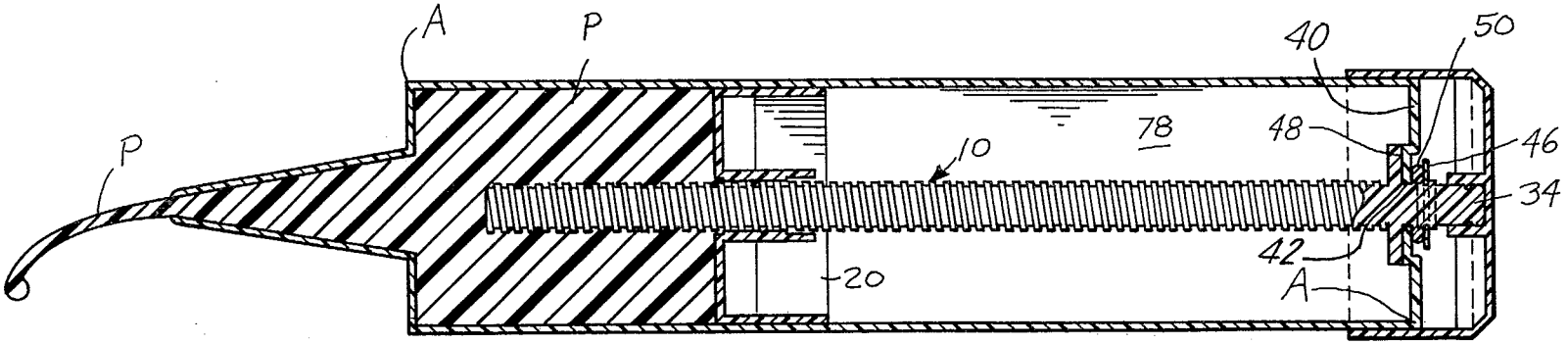
FIG. 3 is a longitudinal sectional view of a tube made of plastics material, containing a filling of fluent, plastic material being dispensed by use of an assembly and twist top of the present invention.

The variation depicted in FIG. 3 is just like the one depicted in FIG. 2, with these exceptions:

The foil/fiber tube 62 and metal ends 40, 64 are replaced by comparable elements molded of conventional plastics material which are secured together at A, preferably by ultrasonic welding.

It should now be apparent that the twist top dispenser as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. For a tube with a dispenser spout at one end of the circular lumen thereof, and an opposite end, a dispenser assembly, comprising:

an annular disk for closing said opposite end of the tube, said disk having a central opening;

a low-pitch lead screw;

a piston of circular outer periphery, said piston having a central bore that is internally threaded and threadably received on the lead screw;

the piston comprising a forwardly presented disk containing said internally threaded central bore, and a coaxially rearwardly extending, tubular peripheral skirt of circular figure;

said skirt having an axially short band of reduced outer diameter disposed where said skirt adjoins said forwardly presented disk;

said lead screw having an axially trailing projection which extends out through said central opening of the annular disk;

means providing a first radially enlarged circumferential boss on the lead screw in extensive face-wise engagement with the inner face of said annular disk peripherally of said central opening;

said first boss being integrally formed with the lead screw;

means providing a second radially enlarged circumferential boss on the lead screw in extensive face-wise engagement with the outer face of said annular disk peripherally of said central opening; and said second boss being removably secured on the lead screw to permit assembly of the annular disk with the lead screw by being provided by a snap-ring removably received in means defining a radially outwardly opening circumferential groove in said projection; whereby, when the annular disk is secured to close the trailing end of a tube containing plastic, fluent material, with a dispenser spout at one end of the lumen thereof, with the forward end of the lead screw disposed within the lumen near the dispenser spout, and with the piston received in said circumferentially engaging the interior of the tube, said axially trailing projection may be twisted to advance the piston and thus dispense the plastic, fluent material from the dispenser spout.

2. The dispenser assembly of claim 1, further including:

an enlarged twist top having an axially forwardly opening socket of non-circular transverse cross-sectional shape;

means providing a trailing end portion of complementary non-circular transverse cross-sectional shape on said projection, said end portion being received in said socket to key rotation of the lead screw to rotation of the twist top;

interfitting bead and groove means formed on said twist top within said socket and on said end portion of said projection for removably retaining said twist top on said end portion.

3. The dispenser assembly of claim 1, further including:

a ring of gasketing material sealingly interposed between one of said bosses and said projection.

4. A dispenser of plastic, fluent material, comprising:

a tube containing plastic, fluent material, with a dispenser spout at the leading end of the circular lumen of said tube, said tube further including a trailing end; and a dispenser assembly, comprising:

an annular disk for closing said opposite end of the tube, said disk having a central opening;

a low-pitch lead screw;

a piston of circular outer periphery, said piston having a central base that is internally threaded and threadably received on the lead screw;

the piston comprising a forwardly presented disk containing said internally threaded central bore, and a coaxially rearwardly extending, tubular peripheral skirt of circular figure;

said skirt having an axially short band of reduced outer diameter disposed where said skirt adjoins said forwardly presented disk;

said lead screw having an axially trailing projection which extends out through said central opening of the annular disk;

means providing a first radially enlarged circumferential boss on the lead screw in extensive face-wise engagement with the inner face of said annular disk peripherally of said central opening;

said first boss being integrally formed with the lead screw;

means providing a second radially enlarged circumferential boss on the lead screw in extensive face-wise engagement with the outer face of said annular disk peripherally of said central opening;

said second boss being removably secured on the lead screw to permit assembly of the annular disk with the lead screw by being provided by a snap-ring removably received in means defining a radially outwardly opening circumferential groove in said projection; and the annular disk being secured to close the trailing end of said tube with the forward end of the lead screw disposed within the lumen near the dispenser spout, and with the piston received in and circumferentially engaging the interior of the tube so that said axially trailing projection may be twisted to advance the piston and thus dispense the plastic, fluent material from the dispenser spout.

5. The dispenser of claim 4, further including:

an enlarged twist top having an axially forwardly opening socket of non-circular transverse cross-sectional shape;

means providing a trailing end portion of complementary non-circular transverse cross-sectional shape on said projection, said end portion being received in said socket to key rotation of the lead screw to rotation of the twist top;

interfitting bead and groove means formed on said twist top within said socket and on said end portion of said projection for removably retaining said twist top on said end portion.

6. The dispenser of claim 4, further including;

a ring of gasketing material sealingly interposed between one of said bosses and said projection.

* * * * *